US010234110B2

(12) United States Patent
Farzan

(10) Patent No.: US 10,234,110 B2
(45) Date of Patent: Mar. 19, 2019

(54) RECESSED LIGHTING FIXTURE WITH INDEPENDENT ADJUSTMENT BETWEEN A LIGHT ASSEMBLY AND A DRIVER ASSEMBLY

(71) Applicant: NORA LIGHTING, INC., Commerce, CA (US)

(72) Inventor: Fred Farzan, Beverly Hills, CA (US)

(73) Assignee: Nora Lighting, Inc., Commerce, CA (US)

( * ) Notice: Subject to any disclaimer, the term of this patent is extended or adjusted under 35 U.S.C. 154(b) by 0 days.

(21) Appl. No.: 15/865,981

(22) Filed: Jan. 9, 2018

(65) Prior Publication Data

US 2018/0202634 A1 Jul. 19, 2018

Related U.S. Application Data

(63) Continuation of application No. 15/677,685, filed on Aug. 15, 2017, which is a continuation-in-part of application No. 29/591,403, filed on Jan. 19, 2017.

(51) Int. Cl.

| | |
|---|---|
| ***F21V 17/02*** | (2006.01) |
| ***F21V 23/00*** | (2015.01) |
| ***F21V 7/04*** | (2006.01) |
| ***F21V 21/22*** | (2006.01) |

(Continued)

(52) U.S. Cl.

CPC ..... *F21V 17/02* (2013.01); *F21S 8/026* (2013.01); *F21V 7/04* (2013.01); *F21V 21/22* (2013.01); *F21V 23/001* (2013.01); *F21V 23/009* (2013.01); *F21V 29/70* (2015.01)

(58) Field of Classification Search

None

See application file for complete search history.

(56) References Cited

U.S. PATENT DOCUMENTS 6,176,599 B1 * 1/2001 Farzen ..... F21S 8/026 362/145

D550,868 S 9/2007 Egawa et al.

(Continued)

OTHER PUBLICATIONS

Taiwan Office Action, Appl. No. 106304088—Based on U.S. Appl. No. 29/591,403, dated Mar. 1, 2018.

(Continued)

*Primary Examiner* — Christle I Marshall

(74) *Attorney, Agent, or Firm* — K&L Gates LLP

(57) ABSTRACT

A recessed lighting fixture apparatus is disclosed. An example apparatus includes a light fixture housing including a first opening configured to face an opening in a ceiling and a light assembly housing configured to slide horizontally within the light fixture housing. The light assembly housing includes a second opening configured to face the opening in the ceiling and a light receptacle. The example apparatus also includes a driver electrically connected to the light receptacle. In a first position, the light assembly housing is positioned within the light fixture housing such that the second opening is aligned with the opening to enable the lighting element to emit light out of the light fixture housing. In a second position, the light assembly housing is slid horizontally within the light fixture housing to enable access through the first opening of the light fixture housing to the driver.

20 Claims, 13 Drawing Sheets

(51) Int. Cl.
*F21S 8/02* (2006.01)
*F21V 29/70* (2015.01)

(56) References Cited

U.S. PATENT DOCUMENTS

| | | | | |
|---|---|---|---|---|
| 7,478,931 | B2 * | 1/2009 | Miletich | F21S 8/02 362/147 |
| 7,503,145 | B2 * | 3/2009 | Newbold | F21S 8/02 52/27 |
| D611,644 | S | 3/2010 | Tsai | |
| 9,383,087 | B2 * | 7/2016 | Rashidi Doust | F21V 21/049 |
| 9,671,091 | B2 * | 6/2017 | Jones | F21V 7/00 |
| 9,726,354 | B1 * | 8/2017 | Delano | F21V 21/14 |
| 2009/0290343 | A1 * | 11/2009 | Brown | F21K 9/00 362/235 |
| 2010/0149822 | A1 * | 6/2010 | Cogliano | F21S 8/02 362/365 |
| 2012/0320577 | A1 * | 12/2012 | Wang | F21V 29/004 362/235 |
| 2017/0307188 | A1 * | 10/2017 | Oudina | F21V 21/04 |

OTHER PUBLICATIONS

Taiwan Office Action, Appl. No. 106304088 dated Jul. 16, 2013—2 pages.
Search Report for Taiwan Patent Appl. No. 106304088 dated Jul. 16, 2018—1 page.

* cited by examiner

RECESSED LIGHTING FIXTURE WITH INDEPENDENT ADJUSTMENT BETWEEN A LIGHT ASSEMBLY AND A DRIVER ASSEMBLY

PRIORITY CLAIM

The present application is a continuation of, claims priority to and the benefit of U.S. patent application Ser. No. 15/677,685, filed on Aug. 15, 2017, which claims the benefit of U.S. Design Patent Application No. 29/591,403 filed on Jan. 19, 2017, the entirety of which are incorporated herein by reference.

BACKGROUND

Walk into any room or store, and there is one thing that most people will take for granted, the lighting. As long as the lighting is sufficient and not distracting, people direct their attention to elements in the room or products on display. However, this quickly changes (for the worse) if there is an inoperative light fixture, a flickering light, a light that emits a high-pitched tone, and/or a light that appears overly bright or dim given the environment. In essence, most lighting is an understated decorative component that is to perform its function as intended while not drawing (significant) attention to itself.

Manufacturers of lighting products, including recessed lighting products, adhere to customer desires by creating lighting products that are generally aesthetically pleasing, cost-efficient, and conform to building/electrical codes. To satisfy different customer tastes and decorative styles, manufactures devote most of their effort creating different lighting designs and features. This includes providing different shaped and colored lighting trim and/or cups, different types of lighting (e.g., track lighting, recessed lighting, pendant lighting, etc.), and different types of illumination (e.g., incandescent, compact fluorescent, light-emitting diode ("LED"), etc.).

Very little effort is spent designing lighting fixtures for service or replacement. From a customer-perspective, these features would not be visible after installation, and accordingly not appreciated. In addition, lighting fixture installation in new construction (or gut-rehab construction) is typically not an issue since the lighting fixtures are installed before the drywall (or plaster) is hung. This enables an electrician to easily attach a lighting fixture to the wall or ceiling studs and connect/route wiring. Hence, manufacturers provide the minimal features necessary to secure a lighting fixture to a wall or ceiling.

Unfortunately, this lack of concern by manufacturers often results in lighting fixtures that are difficult to service or update after initial installation. For example, many lighting fixtures are powered by a driver, ballast, or transformer, which controls power (e.g., current or voltage) provided to a light. Like many electrical devices, a driver, ballast, and transformer may malfunction after extended use or as a result of an internal defect. Drivers, ballasts, and transformers may also malfunction if an incompatible light or dimmer is connected or after a power surge. An inoperable driver, ballast, or transformer results in an inoperable light and customer annoyance. In many lighting fixtures, the driver, ballast, or transformer is placed away from the light to reduce heat buildup. This means that it is often very difficult for an electrician to replace a driver, ballast, or transformer when the only access point is through an opening in a ceiling at the light assembly. In some instances, large sections of a ceiling or wall have to be removed to enable an electrician to reach the driver, ballast, or transformer or to replace the entire lighting fixture. Cutting open a ceiling or wall increases the project cost since the customer has to have the opening closed and repainted.

In another example, customers are increasingly doing minor to moderate home renovation projects. These projects can include lighting changes, such as adding or replacing dimmers and replacing incandescent light bulbs or compact fluorescent lamps with LED lights. To save costs, homeowners and/or electricians attempt to reuse already installed electrical boxes and simply replace the light element/assembly and driver, ballast, or transformer. However, as mentioned above, drivers are oftentimes difficult to reach, thereby making the lighting replacement more difficult. This can lead to some customers forgoing a lighting replacement project altogether due to the extra cost and effort.

SUMMARY

The present disclosure provides a new and innovative recessed lighting fixture apparatus that provides relatively easy access to a driver, ballast, or transformer. The example recessed lighting fixture includes a light fixture housing configured to contain a driver assembly housing and a light assembly housing. Each of the housings may include a sheet metal box with one open side. The driver assembly housing is configured to contain at least one of a driver, a ballast, and a transformer. The light assembly housing is configured to contain a light receptacle and/or an illumination source, such as an LED light, a halogen light, an incandescent light bulb, or a compact fluorescent lamp. The open sides of the light fixture housing, driver assembly housing, and the driver assembly housing are configured to face in a same direction. After installation in a ceiling, each of the open sides are configured to face an internal side of the ceiling, with the light assembly housing being positioned to face an opening in the ceiling for installation of a light fixture or illumination source.

The light assembly housing is moveably connected to the driver assembly housing, thereby enabling the light assembly housing to move or slide vertically relative to the driver assembly housing (and the light fixture assembly). This vertical movement enables the light assembly housing to be pulled downward through the opening in the ceiling. The ability to move downward enables an electrician to more easily access a light fixture and related wiring for service and/or replacement.

The light assembly housing and driver assembly housing are also configured to move together horizontally within the light fixture assembly. This enables the driver assembly housing to be slid over the opening in the ceiling for easy servicing and/or replacement. This also enables a lighting fixture to be easily connected or reconnected to a driver, ballast, or transformer in the driver assembly housing.

In an example embodiment, a recessed lighting fixture apparatus includes a light fixture housing comprising a first box with an open side and closed sides. The light fixture housing includes a first rod connected to an internal surface of one of the closed sides and a second rod connected to an internal surface of one of the closed sides. The example recessed lighting fixture apparatus also includes a driver assembly housing comprising a second box with an open side and closed sides. The driver assembly housing is located within the light fixture housing such that the open side of the driver assembly housing faces the open side of the light fixture housing. The driver assembly housing includes a first slot located along one of the closed sides and is adapted to receive the first rod to enable the driver assembly housing to slide horizontally within the light fixture housing, and a connector located on a second one of the closed sides different from the closed side with the first slot. The example recessed lighting fixture apparatus further includes a light assembly housing comprising a third box with an open side and closed sides. The light assembly housing is located within the light fixture housing such that the open side of the light assembly housing faces the open side of the light fixture housing. The light assembly housing includes a second slot having an L-shape or J-shape located along one of the closed sides. The second slot is adapted to receive the second rod to enable the light assembly housing to slide horizontally or vertically within the light fixture housing. The light assembly housing also includes a third slot located on a second one of the closed sides different from the closed side with the second slot, the third slot adapted to receive the connector of the driver assembly housing to slidably connect the driver assembly housing to the light assembly housing such that the light assembly housing can slide vertically relative to the driver assembly housing.

In another example embodiment, a recessed lighting fixture apparatus includes a driver box with an open side and closed sides. The driver box includes a connector located on one of the closed sides and a window located on the one of the closed sides. The recessed lighting fixture apparatus also includes a light box with an open side and closed sides, the light box being positioned adjacent to the driver box such that the open side of the driver box and the open side of the light box face a same direction. The light box includes a first slot located on one of the closed sides, the slot adapted to receive the connector of the driver box to slidably connect the driver box with the light box such that the light box can slide vertically relative to the driver box. The light box also includes a second slot located on the one of the closed sides and parallel with the first slot, the second slot adapted to align with the window to enable wires to pass from the light box to the driver box.

Additional features and advantages of the disclosed system, method, and apparatus are described in, and will be apparent from, the following Detailed Description and the Figures.

DETAILED DESCRIPTION

Figure 1:
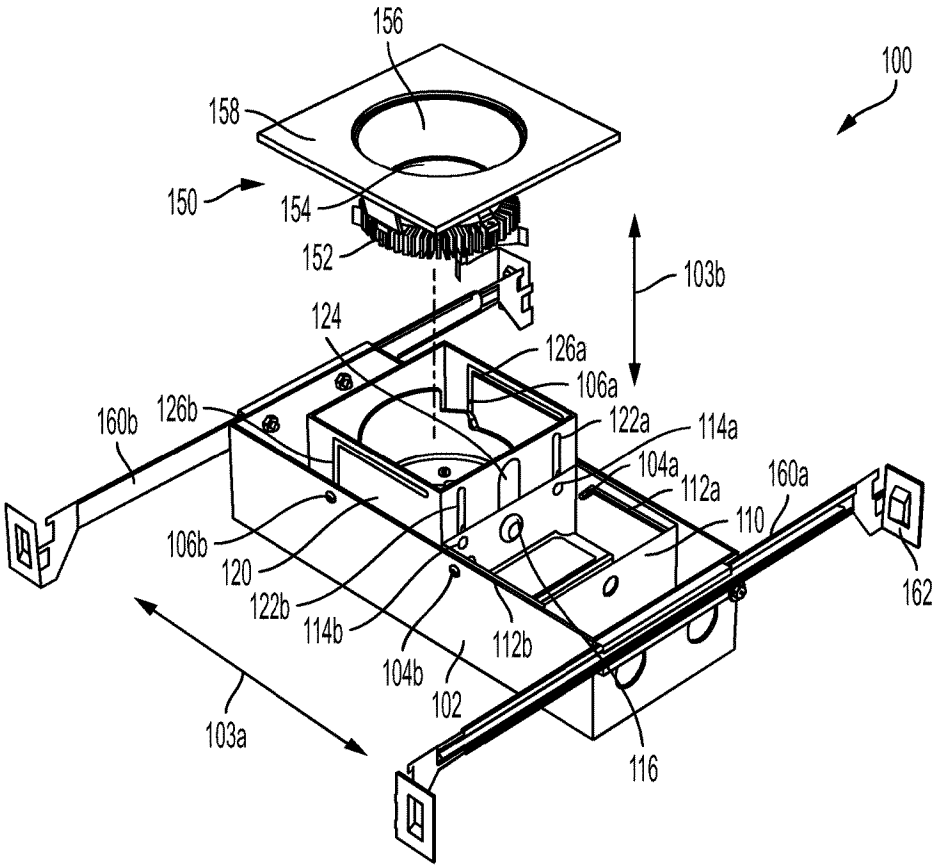
FIG. 1 shows a diagram of a perspective view of a light fixture housing including a driver assembly housing and a light assembly housing, according to an example embodiment of the present disclosure.

The present disclosure relates in general to a recessed lighting fixture and in particular, to a recessed lighting fixture with independent adjustment between a light assembly housing and a driver assembly housing. The example recessed lighting fixture disclosed herein includes a light fixture housing, also referred to herein as a fixture box. The fixture housing is configured to be placed above a ceiling between support beams. In other embodiments, the fixture housing may be positioned behind a wall between support studs. The fixture housing includes a driver assembling housing, referred to in some instances as a driver box, and a light assembly housing, referred to in some instances as a light box. The light assembly housing is configured to include or connect to a light fixture or illumination source. The driver assembling housing is configured to contain an electrical lighting driver, ballast, and/or transformer.

The light assembly housing and the driver assembly housing are configured to move horizontally within the light fixture housing. This enables the driver assembly housing, which is normally shielded from view/access by a ceiling or wall, to be moved in front of an opening for service or replacement. In some embodiments, the driver assembly housing and the light assembly housing are connected together such that they move together in a horizontal direction relative to the light fixture housing, which is secured in place. The light assembly housing is also configured to be moved vertically, relative to the light fixture housing and/or the driver assembly housing. Specifically, the light assembly housing may be pulled or moved downward through an opening in a ceiling (or moved outward through an opening in a wall) to enable relatively easy access for servicing.

While the following disclosure discusses the installation of a light fixture housing relative to a ceiling, it should be appreciated that the light fixture housing may be installed behind a wall or under a floor. Generally, the light fixture housing is meant to be hidden from view while providing mechanical and electrical connection for a light fixture or other illumination source. Further, while the light fixture housing, driver assembly housing, and light assembly housing are shown as being constructed from sheet metal, it should be appreciated that either or all of the housings may include another material, such as plastic, a carbon-fiber composite, a wood compound, and/or combinations thereof.

Further, while the following disclosure references recessed lighting fixtures, it should be appreciated that the light fixture housing, the light assembly housing, and/or the driver assembling housing may be used for other types of lighting, such as track lighting, pendant lighting, rail lighting, cylinder lighting, panel lighting, or sconce lighting. In these other examples, the light assembly housing is configured to provide an electrical connection and/or mechanical connection for different lighting types.

Recessed Lighting Fixture

FIG. 1 shows a diagram of a perspective view of a recessed lighting fixture 100 that includes a light fixture housing 102, according to an example embodiment of the present disclosure. The example light fixture housing 102 includes a rectangular-shaped box with an open side and five closed sides. The open side is configured to face an interior surface of a ceiling and/or wall. The view of the recessed lighting fixture 100 in FIG. 1 is accordingly an upside-down view when the light fixture housing 102 is installed on top of the ceiling. The light fixture housing 102 has a width between 4 inches and 18 inches, preferably between 8 inches and 12 inches. In addition, the light fixture housing 102 has a length between 6 inches and 44 inches, preferably between 24 and 30 inches. Further, the light fixture housing 102 has a depth between 3 inches and 8 inches, preferably, between 4 inches and 6 inches.

The example light fixture housing 102 includes rods 104*a*, 104*b*, 106*a*, and 106*b* that are located on opposite facing closed sides. The rods 104 and 106 are configured to face internally within the light fixture housing 102. In some embodiments, the rods 104 and 106 may be connected by a screw or rivet to the light fixture housing 102. In other examples, the rods 104 and 106 may be welded or chemically connected to the light fixture housing 102. The example rods 104 and 106 are configured to have a circular or ovular profile. In other examples, the rods may have a rectangular profile. Further, in some embodiments, the rods 104 and 106 may be coated and/or infused with an anti-friction material or chemical, such as oil.

As shown in FIG. 1, the rods 104 and 106 are located on closed, oppositely facing sides of the light fixture housing 102. For example, rod 104*a* is located opposite from rod 104*b*. The rods 104 and 106 are located close to the open side of the light fixture housing 102. In some embodiments, the rods 104 and 106 may be less than two inches from the closed side. In other embodiments, the rods 104 and 106 may be located vertically within a middle of the closed sides of the light fixture housing 102. While FIG. 1 shows a pair of opposite facing rods 104 and 106, in other embodiments, the light fixture housing 102 may include only one rod 104 and one rod 106. Alternatively, each side of the light fixture housing 102 may include multiple rods 104 and 106.

The recessed lighting fixture 100 of FIG. 1 also includes a driver assembly housing 110 and a light assembly housing 120. Each of the housings 110 and 120 are configured to fit within the light fixture housing 102 such that open sides of the housings 110 and 120 are facing and/or aligned with the open side of the light fixture housing 102. The driver assembly housing 110 has a width between 4 inches and 18 inches, preferably between 8 inches and 12 inches. In addition, the driver assembly housing 110 has a length between 2 inches and 12 inches, preferably between 6 and 10 inches. The light assembly housing 120 has a width between 4 inches and 18 inches, preferably between 8 inches and 12 inches. Additionally, the light assembly housing 110 has a length between 2 inches and 24 inches, preferably between 6 and 12 inches. Further, the housings 110 and 120 have a depth between 3 inches and 8 inches, preferably, between 4 inches and 6 inches.

As discussed further in conjunction with FIGS. 1 to 9, the housings 110 and 120 are configured to move, with respect to the stationary light fixture housing 102, along a horizontal axis 103*a*. In addition, the light assembly housing 120 is configured to move, with respect to the housings 102 and 110, along a vertical axis 103*b*. As one can appreciate, the reference to horizontal and vertical orientation/movement herein is referenced to the light fixture housing 102 and is independent of how the housing 102 is installed/mounted.

As illustrated in FIG. 1, the driver assembly housing 110 and the light assembly housing 120 have widths that are slightly (e.g., ⅛ or 1/16 of an inch) less than the width of the light fixture housing 102 to enable the housings 110 and 120 to fit within the housing 102 with adequate space to enable sliding along the horizontal axis 103*a*. In addition, it should be appreciated that the driver assembly housing 110 and the light assembly housing 120 have lengths that are less than the light fixture housing 102 to enable the housings 110 and 120 to slide within the housing 102. Preferably, the housings 110 and 120 are dimensioned with respect to the housing 102 to provide enough space for the drive assembly housing 110 to move along the horizontal axis 103*a* to be aligned with an opening in a ceiling that was made for the light assembly housing 120, as discussed further in conjunction with FIGS. 7 to 9. Moreover, the housings 110 and 120 have depths that are equal to or slightly (e.g., ½ to 1/16 of an inch) less than the depth of the light fixture housing 102.

As shown in FIG. 1, the driver assembly housing 110 includes slots 112*a* and 112*b*. The example slots 112*a* and 112*b* are windows or sheet metal cutouts that extend along opposite facing closed sides of the driver assembly housing 110. The slots 112*a* and 112*b* are centered along the respective sides and run along approximately 75% of a length of the sides of the driver assembly housing 110. In other examples, the slots 112*a* and 112*b* may have a smaller length, depending on the lengths of the driver assembly housing 110 and the light fixture housing 102 and/or the amount of room for horizontal movement. The slots 112*a* and 112*b* are configured to enable respective rods 104*a* and 104*b* to pass through. In instances where only the one rod 104*a* is provided, the driver assembly housing 110 only includes slot 112*a*.

The slots 112*a* and 112*b* in combination with the respective rods 104*a* and 104*b* enable the driver assembly housing 110 to slide horizontally within the light fixture housing 102 while being moveably secured to the light fixture housing 102. For instance, the slots 112*a* and 112*b* in combination with the rods 104*a* and 104*b* prevent the driver assembly housing 110 from falling vertically from the light fixture housing 102 when installed.

In some embodiments, the driver assembly housing 110 may include one or more connectors, shown in FIG. 1 as connectors 114*a* and 114*b*. The example connectors 114*a* and 114*b* are configured to mechanically couple the driver assembly housing 110 to respective slots 122*a* and 122*b* of the light assembly housing 120. The connectors 114*a* and 114*b* may include at least one of a screw and a lock nut, screw nut, a hex nut, flange nut, castle nut, or a winged nut. For example, the connectors 114*a* and 114*b* may include a screw that passes through respective slots 122*a* and 122*b* and a nut that closes the end of the screw, thereby securing the housings 110 and 120 together. The connectors 114*a* and 114*b* may be screwed through holes within the driver assembly housing 110 and/or may be connected to the driver assembly housing 110 via a screw, a rivet, a solder, a weld, and/or a chemical fastener. While FIG. 1 shows two connectors 114*a* and 114*b*, it should be appreciated that other embodiments may include fewer connectors or additional connectors. Further, while FIG. 1 shows the connectors 114*a* and 114*b* being located close to the open side of the driver assembly housing 110 (e.g., within one inch from an edge), in other embodiments, the connectors may be located in a middle or bottom of the side of the drive assembly housing.

The illustrated embodiment shows that the driver assembly housing 110 may also include a grommet 116 located on the same closed side as the connectors 114*a* and 114*b*. The grommet 116 is configured to fit within a window of the driver assembly housing 110 to enable wires from the light assembly housing 120 to pass through. The grommet 116 is aligned with a slot 124 on the light assembly housing 120.

The example light assembly housing 120 includes the slots 122*a* and 122*b* for connection to the connectors 114*a* and 114*b* and the slot 124 for contact and/or alignment with the grommet 116. The example slots 122*a* and 122*b* are configured to enable the connectors 114*a* and 114*b* to pass through, respectively. In some instances, the connectors 114*a* and 114*b* may contact the exterior and interior portion of the side of the housing 120 adjacent to the slots 122*a* and 122*b* so as to reduce free-movement of the connectors 114*a* and 114*b* within the slots 122*a* and 122*b*. This enables, for example, the light assembly housing 120 to be retained in place along the vertical axis 103*b* until moved by an electrician. In some instances, the connectors 114*a* and 114*b* may be manually tightened by an electrician to prevent the light assembling housing from moving vertically with respect to the driver assembly housing. For example, the connectors 114*a* and 114*b* may include a wing nut that may be tightened against the side of the light assembly housing 120 adjacent to the respective slots 122.

Additionally, or alternatively, the grommet 116 may be configured to reduce free vertical movement between the housings 110 and 120. For example, the grommet 116 may comprise a rubber or plastic material, which contacts an inside edge of the slot 124. The contact between the grommet 116 and the edges of the slot 124 creates friction that prevents the light assembling housing 120 from freely moving along the vertical axis 103*b*. The force of the friction may be overcome by an electrician manually moving the housing 120. Such a configuration enables the housing 120 to be lowered or raised into a desired position for service and/or installation. In other examples, the contact between the grommet 116 and the edges of the slot 124 is minimal, enabling free movement of the housing 120.

As illustrated in FIG. 1, the slots 122 and 124 are parallel to each other and aligned along the vertical axis 103*b*. Such alignment of the slots 122 and 124 enables the light assembly housing 120 to move or slide along the vertical axis 103*b* while the driver assembly housing 110 remains stationary. The length of the slots 122 and 124 define how much the light assembly housing 120 may move along the vertical axis 103*b*, with shorter slots 122 and 124 corresponding to less movement. As discussed above, the light assembly housing 120 is movable along the vertical axis 103*b* to enable an electrician to access lighting components within the housing 120 and/or to install a light fixture, illumination source, and/or a recessed light assembly 150. An electrician may also more easily route wires from the light assembling housing 120 through the slot 124 and the grommet 116 to the driver assembly housing after the housing 120 has been pulled down. The stationary position of the grommet 116 ensures that the wires do not move vertically at a border between the housings 110 and 120 and prevents the wires from being frayed or cut by the slot 124.

The example light assembly housing 120 of FIG. 1 also includes L-shaped or J-shaped slots 126*a* and 126*b*. The slots 126*a* and 126*b* are configured to receive rods 106*a* and 106*b*, respectively. Each of the slots 126*a* and 126*b* has a horizontal portion that is aligned with the horizontal axis 103*a*. The horizontal portion of the slots 126*a* and 126*b* enables the light assembly housing 120 to move or slide horizontally within the light fixture housing 102. The slots 126*a* and 126*b* also include a vertical portion, which is aligned with the vertical axis 103*b*. The vertical portion of the slots 126*a* and 126*b* enables the light assembly housing 120 to move or slide vertically with respect to the driver assembly housing 110.

The horizontal portion of the slots 126*a* and 126*b* have substantially the same length as the slots 112*a* and 112*b*. Having the same length as slots 112 and 126 enables the housings 110 and 120 to have the same range of horizontal motion, which is important if the housings 110 and 120 are connected together. In addition, the length of the vertical portion of the slots 126*a* and 126*b* is substantially the same as the length of slots 122*a*, 122*b*, and 124. Having the same length slots 122, 124, and 126 enables the light assembly housing 120 to slide or move vertically with respect to both the driver assembly housing 110 and the light fixture housing 102.

It should be appreciated that the location of the vertical portion of the L-shaped or J-shaped slots 126 is positioned on the respective sides of the light assembly housing 120 in relation to an anticipated opening in a ceiling or a wall. In other words, the ceiling opening is created and/or the recessed light fixture 100 is positioned to align with the light assembly housing 120 so that the rods 106 are located within (or close to) the vertical portion of the slots 126. This enables the light assembly housing 120 to be pulled downward through an opening in the ceiling, as discussed further in connection with FIGS. 7 to 9. Otherwise, a closed portion of the ceiling would block the light assembly housing 120 from moving downward when the housing 120 is slid such that the rods 106 are positioned within the vertical portion of the respective slots 126. The example L-shaped or J-shaped slots 126 accordingly enable the light assembly housing 120 to move along the horizontal axis 103*a* when the rods 106 are positioned within the horizontal portion of the slots 126 and move along the vertical axis 103*b* when the rods 106 are positioned within the vertical portion of the slots 126. This configuration of rods 106 and slots 126 prevents the light assembly housing 120 from falling or moving downward when not positioned over an opening in a ceiling and also prevents the light assembly housing 120 from moving horizontally when the housing 120 is pulled downward.

The example light assembly housing 120 is configured to mechanically and/or electrically connect to a light fixture or recessed light assembly 150. The recessed light assembly 150 shown in FIG. 1 includes a heat sink 152, a lighting element 154, a cup 156, and a trim piece 158. It should be appreciated that design and appearance of the trim piece 158, the cup 156, the lighting element 154, and the heat sink 152 is illustrative of a light fixture for use in the recessed lighting fixture 100. In other embodiments, the shape and/or design of the heat sink 152, lighting element 154, the cup 156, and the trim piece 158 may be different. For example, the cup 156 and trim piece 158 may be replaced with a pendant and pole for a hanging lighting fixture.

The heat sink 152 is configured to absorb and disperse heat generated from the lighting element 154. The heat sink 152 may include a connector for electrical and/or mechanical connection with the light assembly housing 120. The light element 154 may include any type of light or illumination source including, for example, a LED light, a halogen light, an incandescent light bulb, or a compact fluorescent lamp. The example cup 156 includes a plastic and/or metallic reflector and/or deflector. Depending on a desired lighting effect, the cup 156 may be configured to absorb light, reflect light, and/or reflect different colors of light. In some instances, the cup may include a pattern or fringe to adjust light reflection/absorption. The example trim piece 158 is configured to provide a decorative cover for an opening in a ceiling or wall. The trim piece 158 is configured, for example, to be placed flush against an exterior side of a ceiling.

The example recessed lighting fixture 100 of FIG. 1 also includes mounting bars 160*a* and 160*b* configured to connect to ceiling beams or wall studs. The mounting bars 160*a* and 160*b* are connected to external surfaces of opposite facing closed sides of the lighting fixture housing 102. While FIG. 1 shows the mounting bars 160 positioned along a width of the housing 102, in other examples, they may be positioned along a length of the housing 102.

The example mounting bars 160 may be telescoping to enable their length to be adjusted. This telescoping feature enables the mounting bars 160 to be positioned to fit between adjacent ceiling beams or wall studs. The mounting bars 160 include brackets 162 at each end, which are configured to contact the ceiling beams or wall studs. The brackets 162 are connected at a right angle such that a surface of the bracket contacts sides of the beams or studs. The brackets 162 may include a tab including a hole or window, which guides a nail into the ceiling beams or wall studs.

Figure 2:
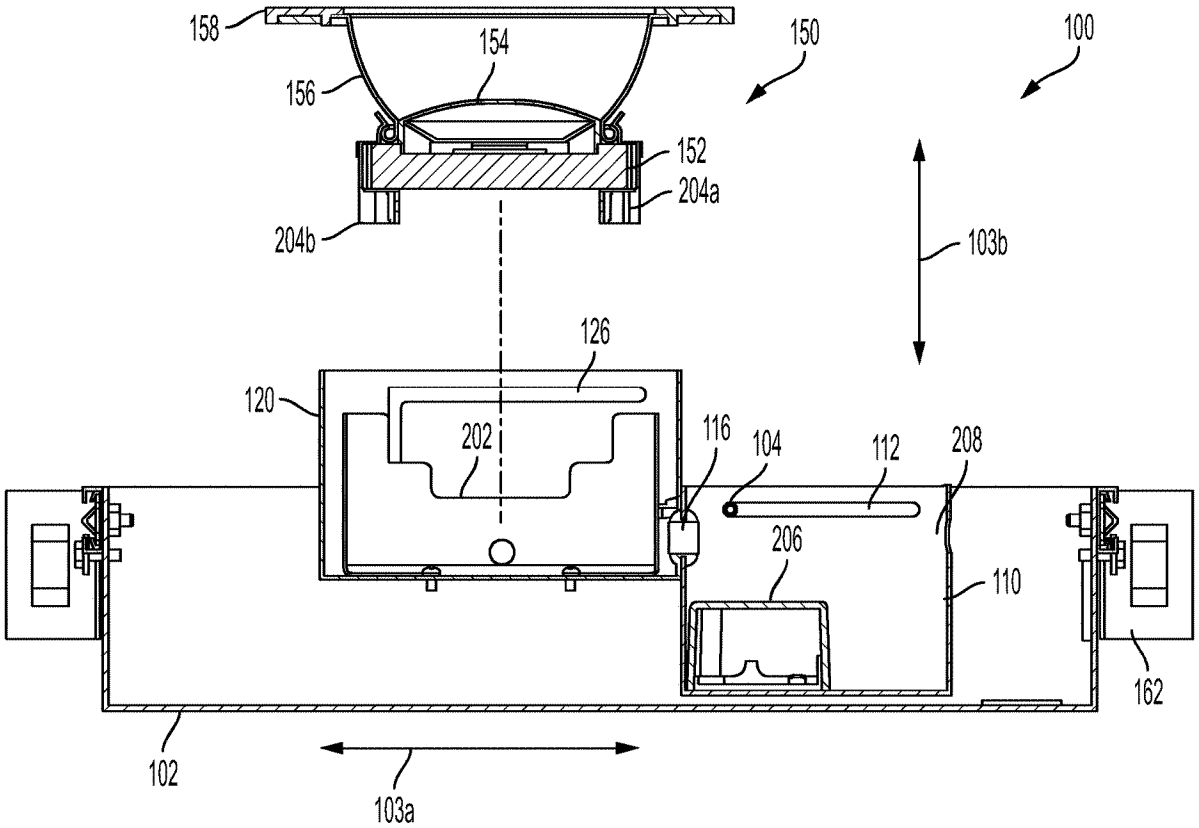
FIG. 2 shows a side-view of the light fixture housing of FIG. 1, according to an example embodiment of the present disclosure.

FIG. 2 shows a side-view of the recessed lighting fixture 100 of FIG. 1, according to an example embodiment of the present disclosure. In this diagram, the near closed sides (from the perspective of the viewer) of the housings 102, 110, and 120 are made transparent. As shown in FIG. 2, the housings 110 and 120 have been slid all the way to the right (from the perspective of the viewer) such that the rod 104 is at the end of the slot 112 and the rod 106 (not shown) is within a vertical portion of the slot 126. This positioning of the housings 110 and 120 enables the light assembly housing 120 to be moved upward (with reference to the viewer, but downward in actual use in a ceiling) along the vertical axis 103*b*.

As shown in FIG. 2, a diameter of the rod 104 is slightly smaller than a diameter of the slot 112. This enables the rod 104 to pass through the slot 112 during manufacture and slide along the slot 112 during use. In a similar manner, the diameter of the rod 106 is slightly smaller than the diameter of the slot 126.

FIG. 2 shows that the light assembly housing 120 includes a light receptacle 202 configured to connect to or otherwise accommodate or accept a connector 204 of the recessed light assembly 150. In some examples, the connectors 204*a* and 204*b* may respectively provide a power and ground connection to respective terminals within the light receptacle 202. Additionally or alternatively, the connectors 204*a* and 204*b* are configured to mechanically engage corresponding connectors within the light receptacle 202. In instances where only a mechanical connection is made, wires are routed from the recessed light assembly 150 to the light receptacle 202 and through the grommet 116 to a driver 206. Otherwise, if the connectors 204*a* and 204*b* provide an electrical connection to the light receptacle 202, wires may be routed from the light receptacle 202 through the grommet 116 to the driver 206. It should be appreciated that many different types of electrical and/or mechanical connectors may be used to secure the recessed light assembly 150 to the light assembly housing 120.

The example driver 206 is configured to regulate or control power to the lighting element 154. The driver 206 may include any electrical driver, ballast, and/or transformer. In some examples, the driver 206 may concert AC power to a specified DC voltage and/or adjust voltage according to a pulse width modulation ("PWM") signal received from a dimmer switch. Additionally or alternatively, the driver 206 may send control power to the lighting element 154 through a PWM signal. The driver 206 receives power and ground from an electrical circuit in a structure, which may be routed through window 208 of the driver assembly housing 110.

As shown in FIG. 2, the driver 206 is mechanically connected to a closed side (opposite of the open side) of the driver assembly housing 110. The driver 206 is electrically connected to the lighting element 154 (directly or indirectly) via at least a power wire and a ground wire. The wires are routed through the grommet 116 of the driver assembly housing 110. The grommet 116 is shown as passing through a window of the driver assembly housing 110 and the slot 124 of the light assembly housing 120. The positioning of the grommet 116 prevents the wires from contacting edges of the sheet metal of the housing 110 and 120, especially when the light assembly housing 120 slides vertically relative to the driver assembly housing 110. The grommet 116 accordingly prevents the wires from fraying or being spliced from the sharp sheet metal edges of the slot 124 of the housing 120 and the window of the housing 110. In addition, the capability of pulling the light assembly housing 120 out from the lighting fixture housing 102 provides easier access for an electrician to route wires through the grommet 116 from the housing 120 to the driver assembly housing 110.

Figure 3:
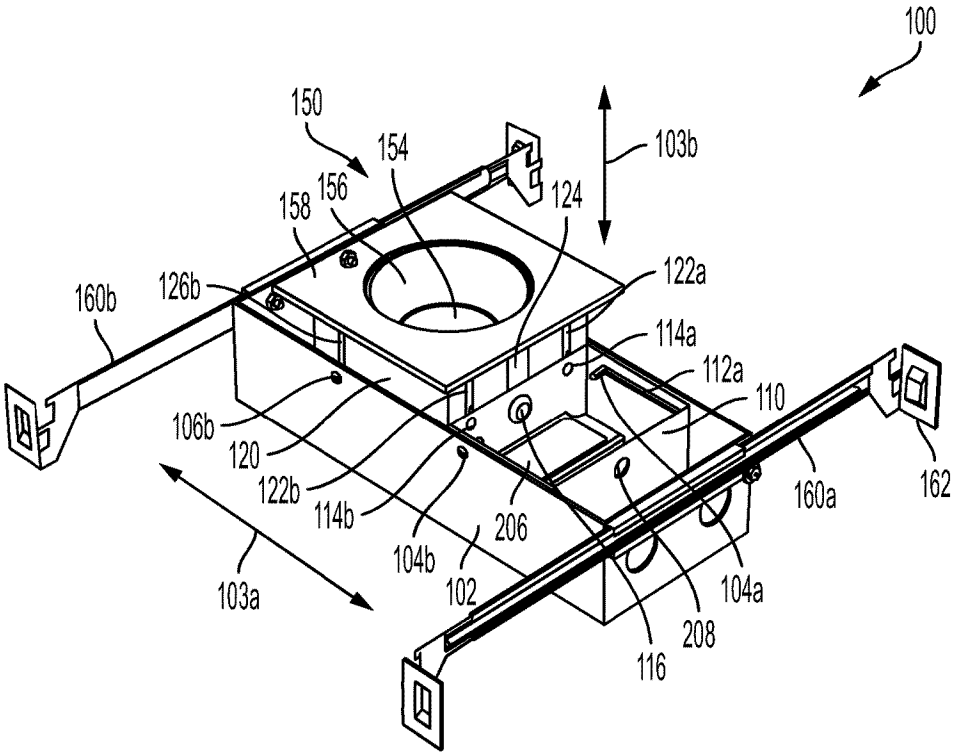
FIG. 3 shows a diagram of a perspective view of the light fixture housing of FIG. 1 with a recessed light assembly connected to the light assembly housing, according to an example embodiment of the present disclosure.

FIG. 3 shows a diagram of a perspective view of the recessed lighting fixture 100 of FIGS. 1 and 2 with the recessed light assembly 150 connected to the light assembly housing 120, according to an example embodiment of the present disclosure. Once installed, the light assembly housing 120 may be slid vertically back into the light fixture housing 102 such that the trim piece 158 contacts an exterior surface of a ceiling and/or wall, thereby covering the opening. In addition, the light assembly housing 120 may be slid left slightly to prevent the housing 120 from moving vertically after installation.

In some examples, the light fixture housing 102 may not be installed flush against the interior side of the ceiling. Instead, a gap of a few inches may exist between the ceiling and the housing 102. In these instances, the vertical adjustment of the light assembling housing 120 enables an electrician to set the desired height to ensure the trim piece is flush against the ceiling. The light assembly housing 120 may be held in place vertically via the grommet 116 contacting edges of the slot 124 and/or via locking nuts of the connectors 122.

Figure 4:
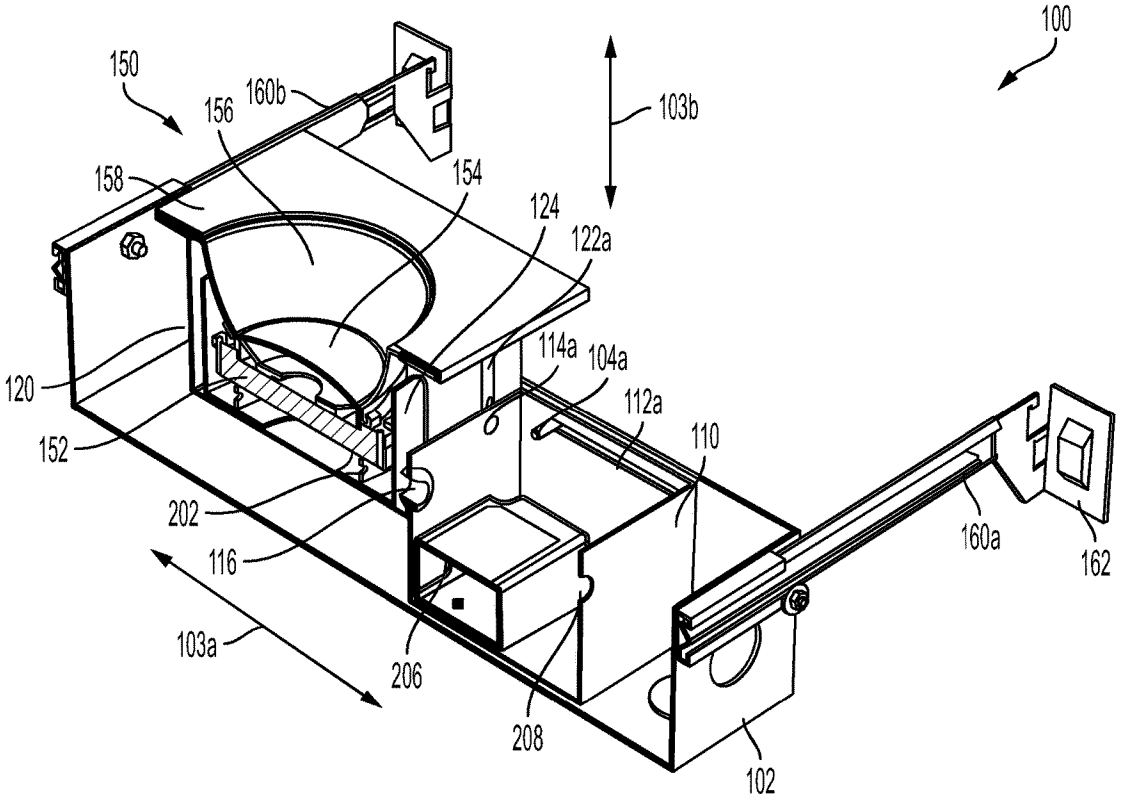
FIG. 4 shows a diagram of a cross-sectional perspective view of the light fixture housing of FIG. 3, according to an example embodiment of the present disclosure.
Figure 5:
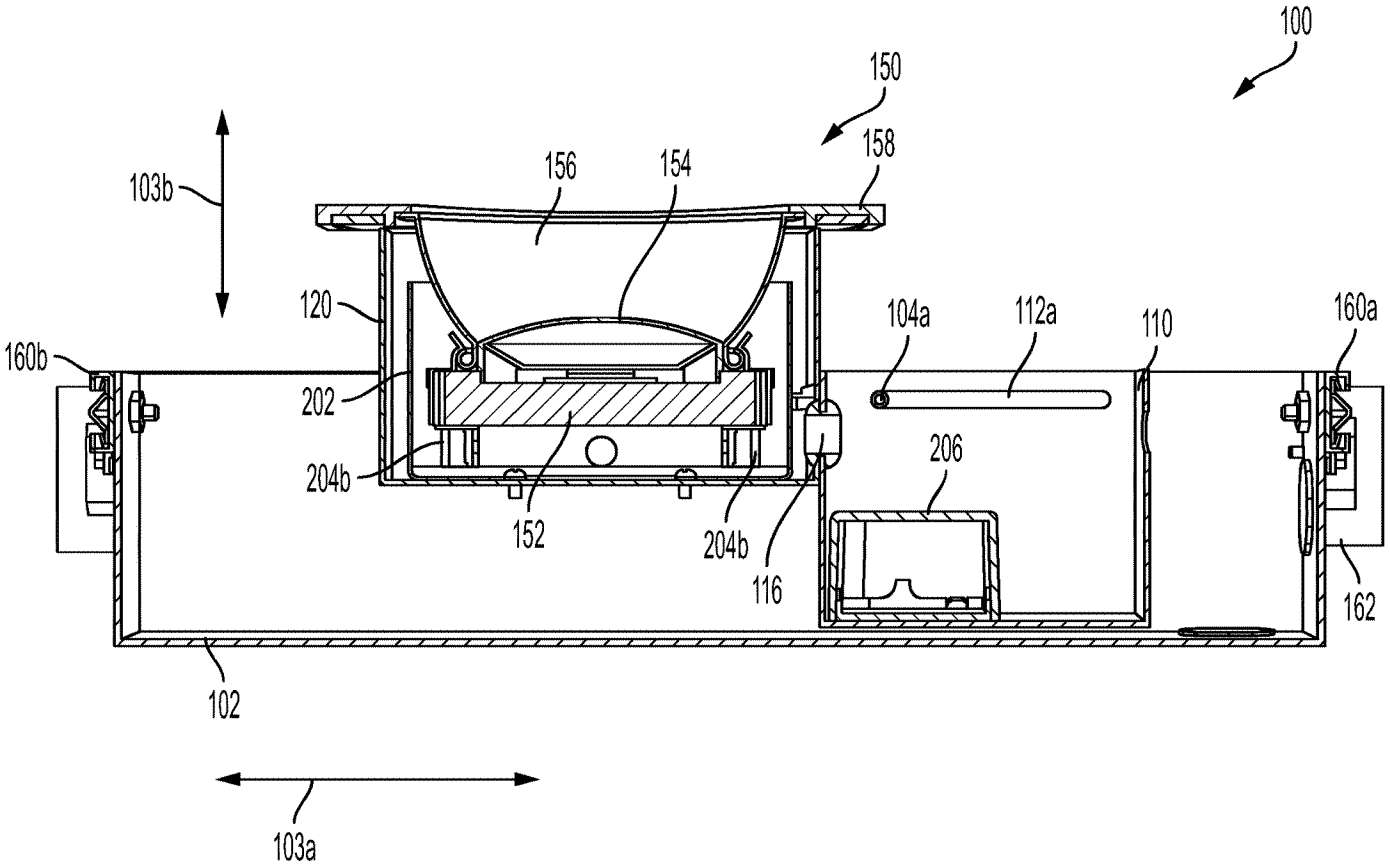
FIG. 5 shows a cross-sectional side view of the light fixture housing of FIG. 3 with a side of the light fixture housing made transparent, according to an example embodiment of the present disclosure.

FIG. 4 shows a diagram of a cross-sectional perspective view of the recessed lighting fixture 100 of FIG. 3, according to an example embodiment of the present disclosure. In addition, FIG. 5 shows a cross-sectional side view of the recessed lighting fixture 100 of FIG. 3, according to an example embodiment of the present disclosure. The cross-section of FIGS. 4 and 5 is taken at a mid-point of the width of the housings 102, 110, and 120, effectively slicing them in half.

FIGS. 4 and 5 illustrate the connection between the light receptacle 202 and the connectors 204*a* and 204*b* of the recessed light assembly 150. Specifically, the example connectors 204*a* and 204*b* are configured to fit into corresponding openings or terminals of the light receptacle 202. The connection occurs in proximity of the heat sink 152. FIGS. 4 and 5 also illustrate a lip of the trim piece 158 that is configured to contact an external surface of a ceiling or wall. The trim piece 158 covers the opening in the ceiling or wall in addition to the light assembly housing 120, the heat sink 152, connectors 204, and backside of the cup 156.

Figure 6:
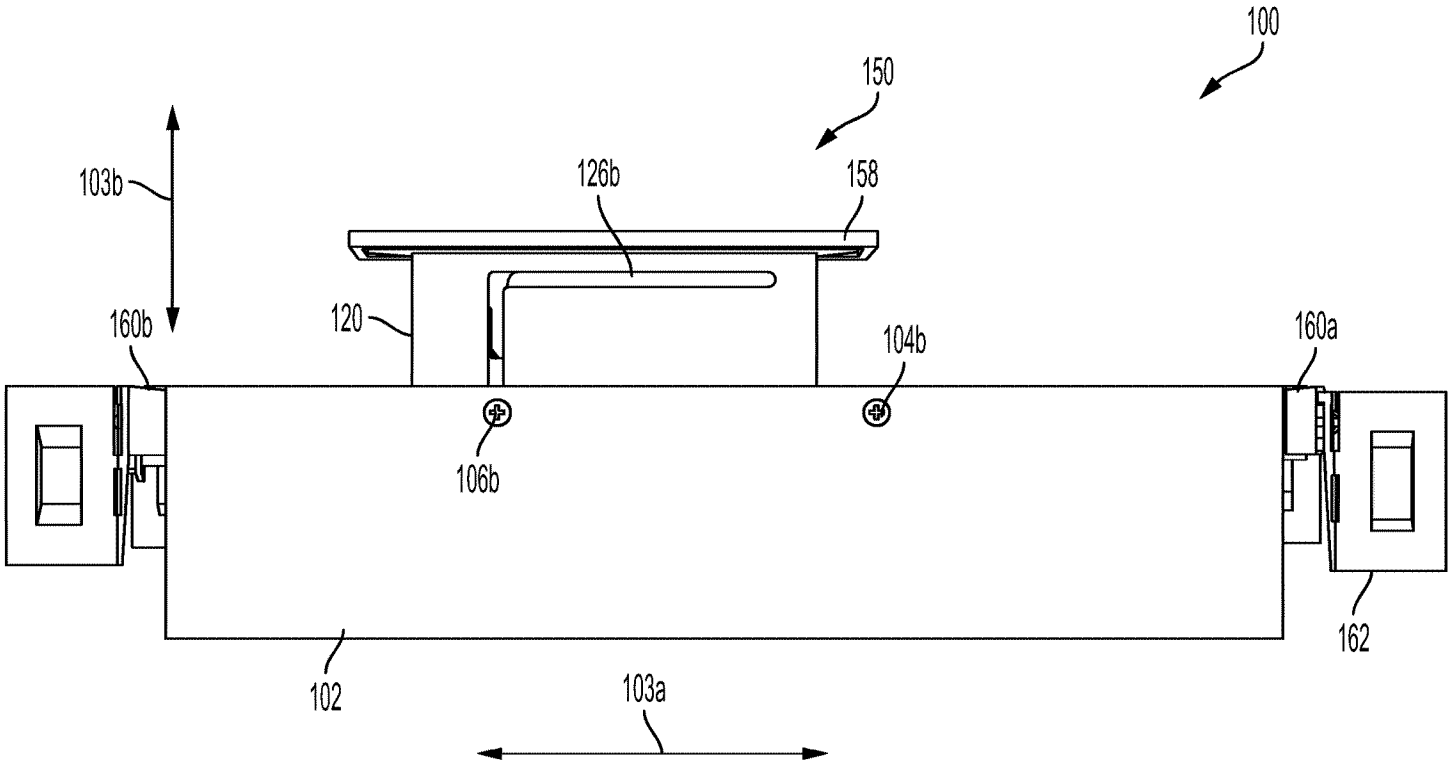
FIG. 6 shows the side-view of the light fixture housing of FIG. 5 with the side of the light fixture housing being shown as opaque, according to an example embodiment of the present disclosure.

FIG. 6 shows the side-view of the recessed light fixture 100 of FIG. 5 with the side of the light fixture housing 102 being shown as opaque, according to an example embodiment of the present disclosure. In this illustrated embodiment, the rods 104*b* and 106*b* are shown as comprising screws provided through holes in the light fixture housing 102. In particular, screws are placed through the holes in the light fixture housing 102 and attached to the rods 104*b* and 106*b*. In some embodiments, the screws may be integrated with the rods 104*b* and 106*b* to form a single structure. Alternatively, the screws may be replaced with rivets.

In this example, the light assembly housing 120 is vertically raised (or lowered depending on installation and perception) from the light fixture housing 102. Accordingly, the rod 106*b* is shown as being in a vertical portion of the L-shaped or J-shaped slot 126*b*. As discussed above, the light assembly housing 120 may be moved vertically based on the rod 126*b* sliding within the vertical portion of the slot 126*b*. The light assembly housing 120 (in conjunction with the driver assembly housing 110, when connected) moves along the horizontal axis 103*a* with the rod 106*b* sliding along the horizontal portion of the slot 126*b*. For the horizontal movement to occur, the light assembly housing 120 has to be completely retracted within the light fixture housing 102 to enable the rod 106*b* to slide within the horizontal portion of the slot 126*b*.

Recessed Lighting Fixture Usage Embodiment

Figure 7:
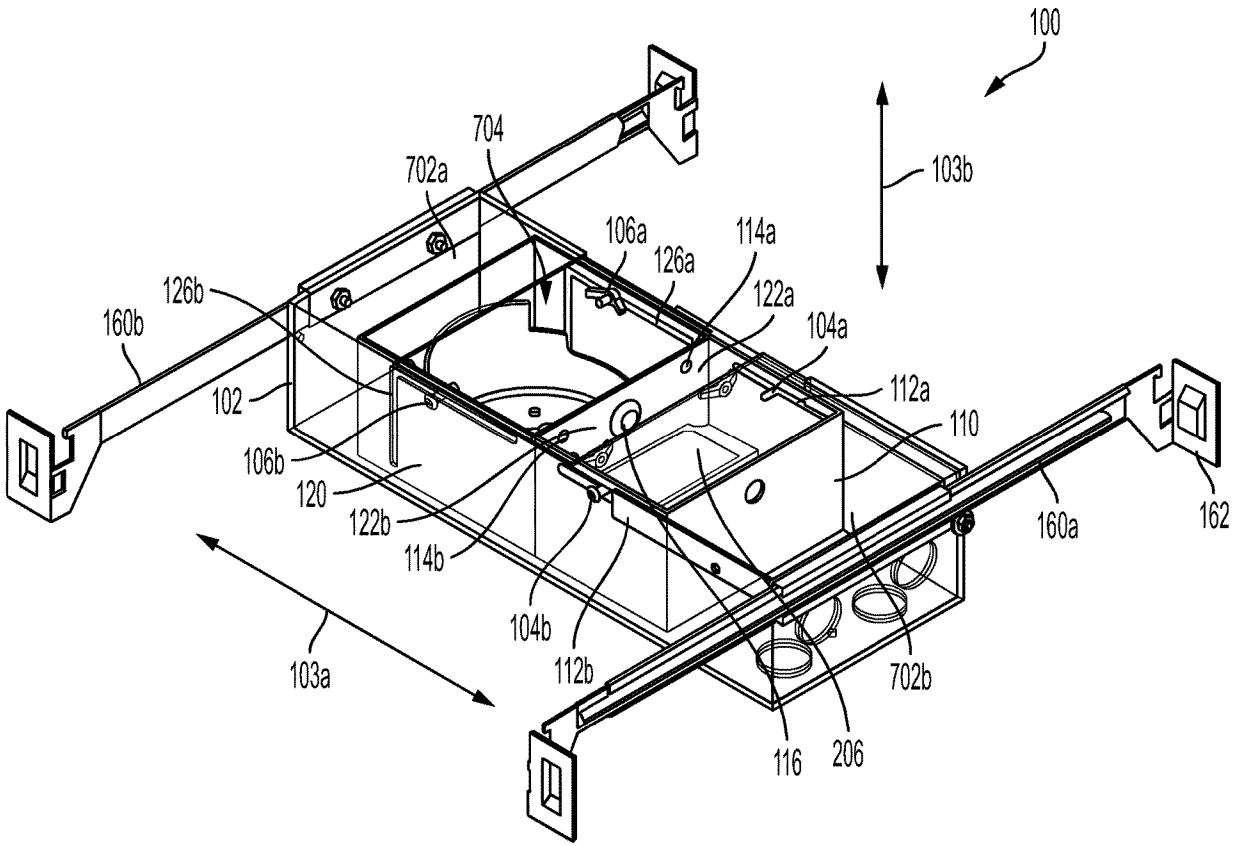
FIGS. 7 to 9 show diagrams of the light assembly housing and the driver assembly housing moving or sliding within the light fixture housing, according to an example embodiment of the present disclosure.
Figure 8:
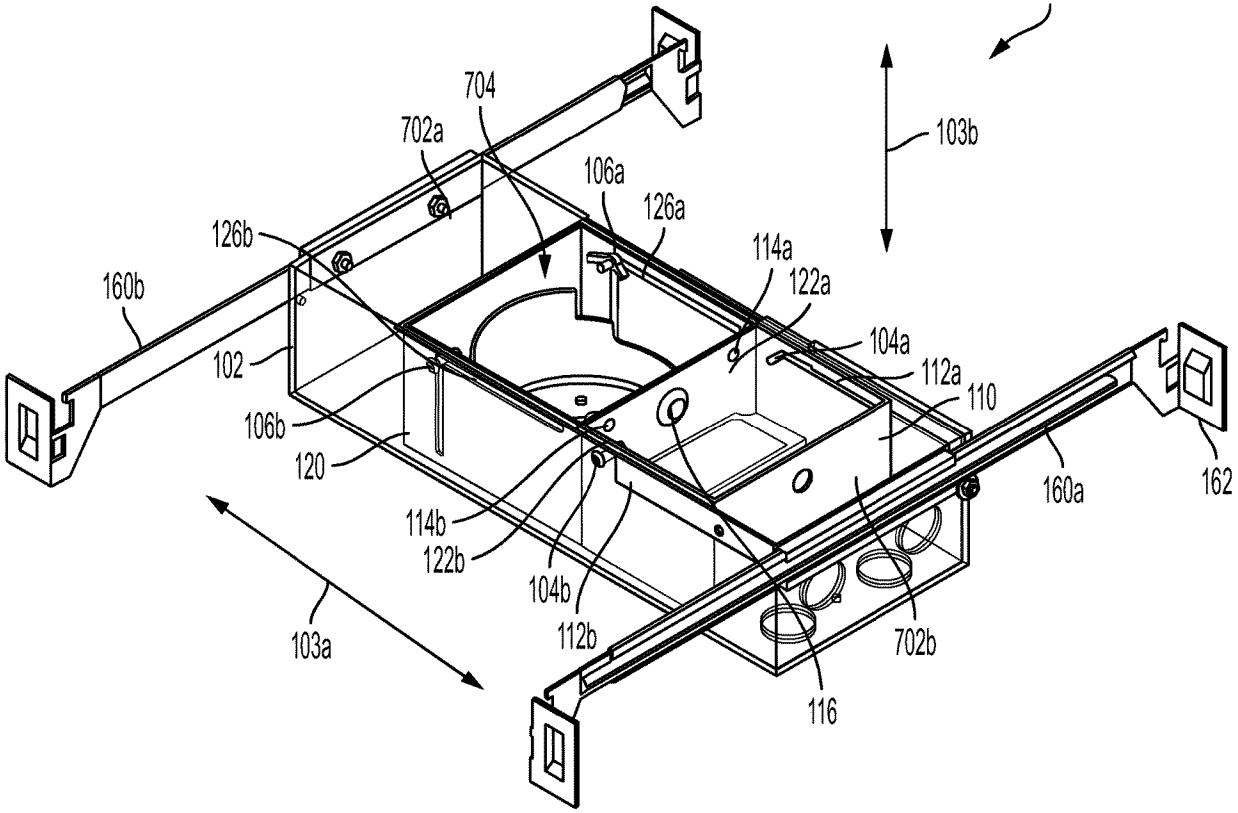
Figure 9:
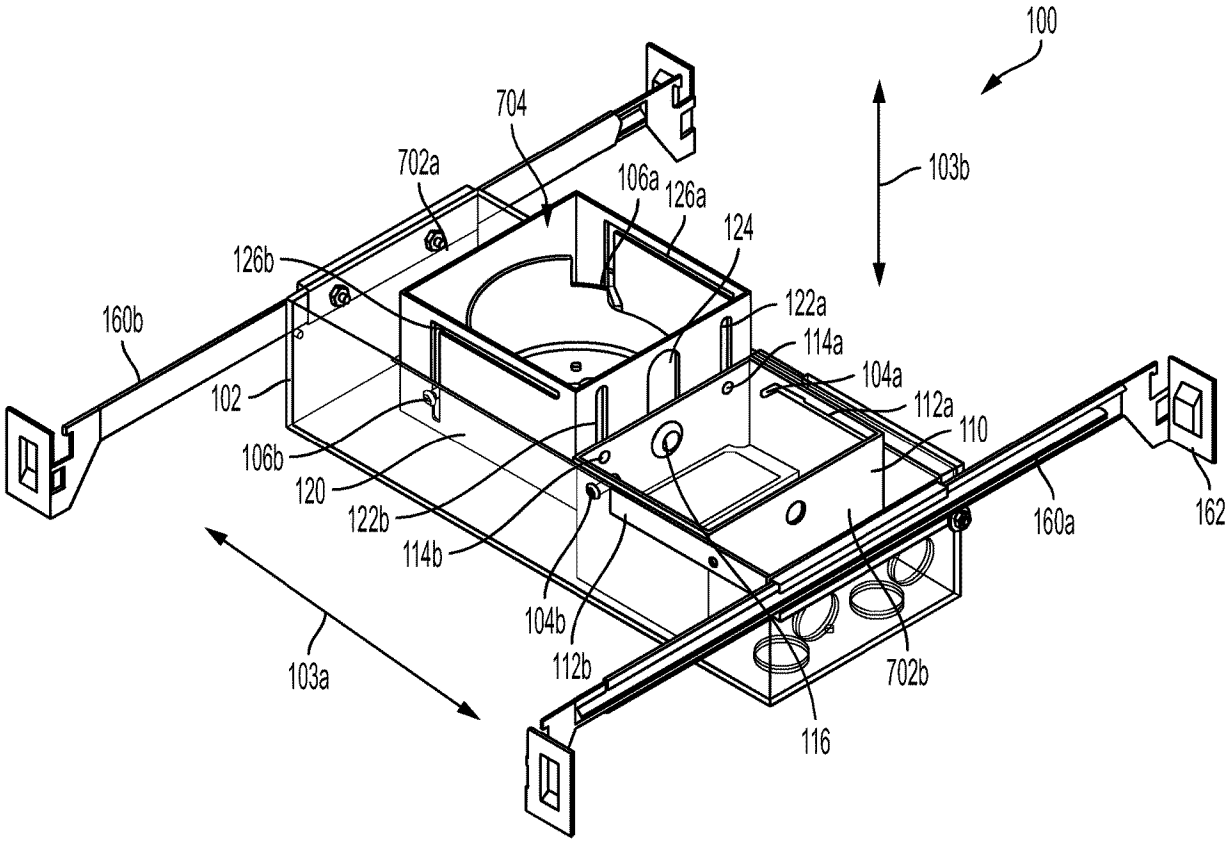

FIGS. 7 to 9 show diagrams of the housings 110 and 120 within the recessed lighting fixture 100 of FIGS. 1 to 6 being moved for servicing, according to an example embodiment of the present disclosure. In these figures, the light fixture housing 102 is shown with transparent closed sides to illustrate the position of the rods 104 and 106 within the respective slots 112 and 126. In addition, FIGS. 7 to 9 show the position of the recessed lighting fixture 100 with reference to a ceiling 702, which is also displayed as being transparent. The view of FIGS. 7 to 9 is accordingly provided upside-down compared to a perspective view of the recessed lighting fixture 100 when actually installed.

In the illustrated example of this embodiment, the ceiling 702 includes an opening 704, which is approximately a little larger than the open side of the light assembly housing 120. In FIG. 7, the housings 110 and 120 are shown as being slide to the left (from a perspective of the view) to enable at least a portion of the driver assembling housing 110 to be facing the opening 704. In some instances, the housings 110 and 120 may be slid as far to the left as possible to align the entire open side of the driver assembly housing 110 with the opening 704. This enables, for example, an electrician to easily service and/or replace the driver 206 through the opening 704. The electrician may also relatively easily route wires from the driver 206 through the grommet 116 to the light assembly housing 120.

In the position shown in FIG. 7, the rods 104 are located within a mid-section or towards the right section of slots 112, respectively. In addition, the rods 106 are located within a mid-section or towards the right section of the horizontal portion of slots 126, respectively. The position of the rods 106 within the horizontal portion of the slots 126 prevents the light assembling housing from being pulled (or otherwise moving) downward, which could potentially damage the ceiling.

FIG. 7 also shows an example where the rods 106 include a wing nut, which may be used to lock or prevent movement of the light assembly housing 120. For example, an electrician may loosen the wing nuts of the rods 106 to slide the housings 110 and 120 horizontally or slide the housing 120 vertically. The electrician may then tighten the wing nut when the housings 110 and 120 are in a desired position to prevent further movement of the housings 110 and 120 during servicing and/or after servicing is complete. For instance, the electrician may tighten the wing nuts when the rods 106 are at a mid-point within the vertical portion of the slots 126 to set a desired vertical position of the light assembly housing.

Transitioning from FIG. 7 to FIG. 8, the wing nuts are loosened from the rods 106, which enables the housings 110 and 120 to slide horizontally. Specifically, the housings 110 and 120 are moved to the right along the horizontal axis 103*a* within the light fixture housing 102. This sliding causes the driver assembly housing 110 to be covered by the ceiling 702*b* while aligning the light assembly housing 120 with the opening 704. Once the light assembly housing 120 is aligned with the opening 704, an electrician may pull or move the housing 120 downward (shown as being moved upward in FIG. 9) to enable relatively easy installation of the recessed light assembly 150. This alignment with the opening 704 is helped, in part, by the rods 106 contacting the intersection of the horizontal and vertical portions of slots 126. At this point, the rods 106 may slide through slots 126 vertically.

FIG. 9 shows the light assembling housing 120 sliding along the vertical axis 103*b*, through the opening 704 while the driver assembly housing 110 and the light fixture housing 102 remain stationary. The rods 106 are shown as being slid within the vertical portions of slots 126 (through the sliding of the slots 126 relative to the rods 106). An electrician may tighten the wing nuts to lock the vertical position of the light assembly housing 120. In addition, the position of the rods 106 within the vertical portion of the slots 126 prevents the housings 110 and 120 from moving horizontally.

Also, as shown in FIG. 9, during the vertical sliding of the light assembly housing 120, the slots 122 slide along the connectors 114 such that bottom end of the slots 122 approach the connectors 114, respectively. In addition, the bottom end of the slot 124 approaches the grommet 116. The slots 122 and 124, the connectors 114, and the grommet 116 enable the light assembly housing 120 to move vertically relative to the driver assembly housing 110 through the opening 704. After servicing or installation is complete, the electrician slides the light assembly housing 120 back into the light fixture housing 102 such that a trim piece is flush with the ceiling 702.

Alternative Embodiments

As discussed throughout, the rods 104 and 106 are physically connected to the light fixture housing 102 and the slots 112, 122 and 126 are included within the housings 110 and 120, respectively. In other embodiments, the rods 104 may be connected to the driver assembly housing 110 and the rods 106 may be connected to the light assembly housing 120. In addition, the slots 112 and 126 may be located within the light fixture housing 102 to receive the respective rods 104 and 106. The length and shape of the slots may be similar to the slots 112 and 126 shown in FIGS. 1 to 9. Despite the reversal between the rods 104 and 106 and the slots 112 and 126, the configuration would still enable the housings 110 and 120 to move horizontally within the light fixture housing 102.

Additionally or alternatively, the connectors 114, grommet 116 and slots 122 and 124 may be reversed. Specifically, the connectors 114 and grommet 116 may be included within the light assembly housing 120 while the slots 122 and 124 are included within the driver assembly housing 110. Despite the reversal between the connectors 114 and the slots 122, the configuration would still enable the light assembly housing 120 to move vertically with respect to the driver assembly housing 110.

In another embodiment, the housings 110 and 120 may not be connected together. In this alternative embodiment, the driver assembly housing 110 may not include the connectors 114 while the light assembly housing 120 may not include the slots 122. However, the driver assembly housing 110 may include the grommet 116 and the light assembly housing 120 may include the slot 124 to enable wires to be routed between the housings 110 and 120. This configuration would enable the housings 110 and 120 to independently slide horizontally.

In yet another embodiment, the light fixture housing 102 may be omitted. In this embodiment, the light fixture housing 102 may be replaced by two parallel rails that are positioned adjacent to the slots 112 and 126 on opposite facing closed sides of the housings 110 and 120. Each of the rails may include the rods 104 and 106, which receive the rods 104 and 106, respectively. The rails may be similar to the mounting bars 160 and include brackets for attachment to ceiling beams or wall studs. In this embodiment, the mounting bars 160 may be omitted. As an alternative in this embodiment, the rails may include the slots 112 and 126 while the housings 110 and 120 include the rods 104 and 106, respectively. In either instance, the housings 110 and 120 may slide horizontally with respect to the rails. In addition, the housing 120 may slide vertically with respect to the rails.

Figure 10:
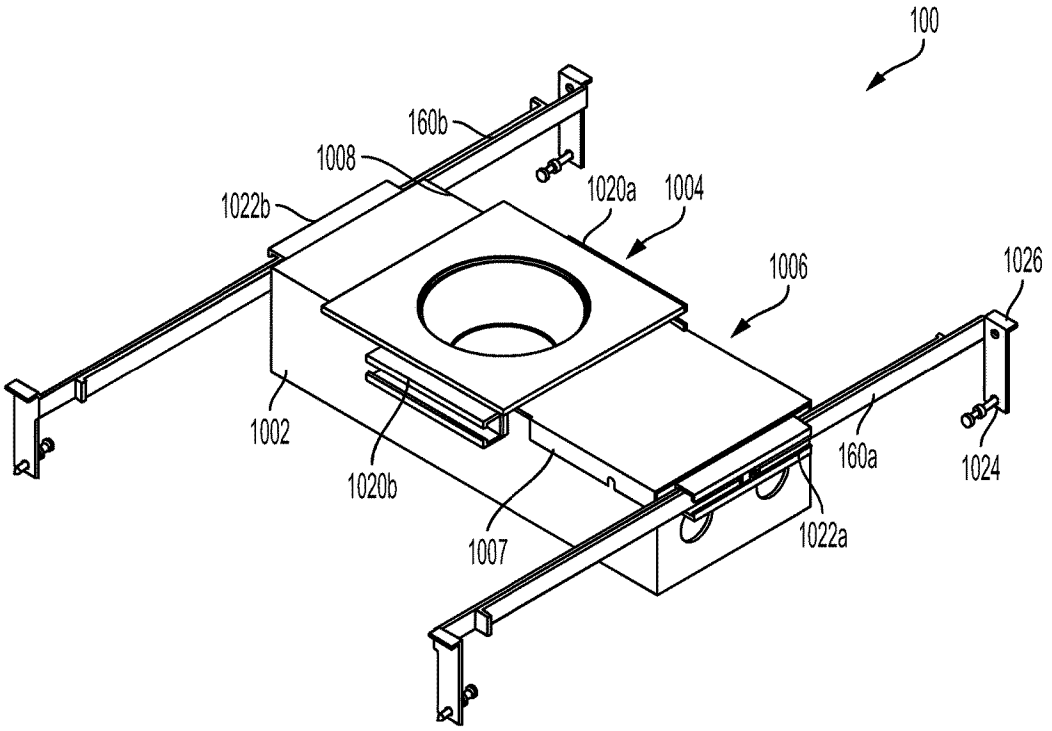
FIGS. 10 and 11 show diagrams of a perspective view of a recessed lighting fixture having a light fixture housing that includes a light assembly housing and a driver assembly housing, according to another example embodiment of the present disclosure.
Figure 11:
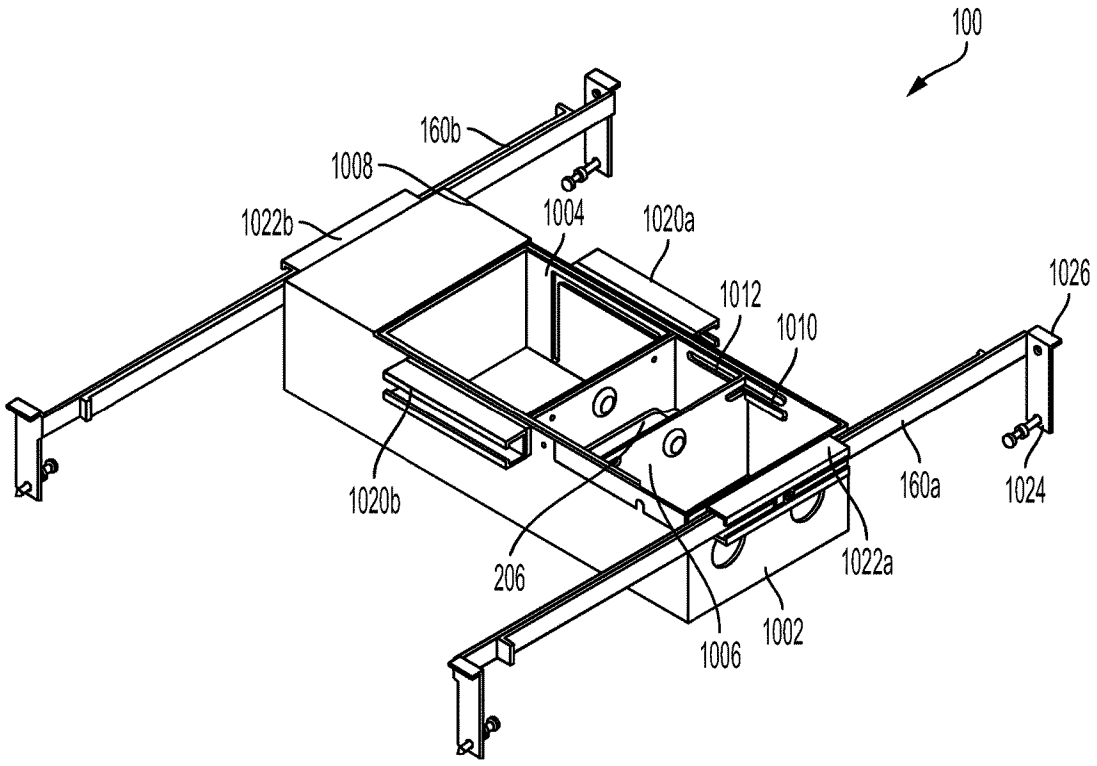

FIGS. 10 and 11 show diagrams of a perspective view of a recessed lighting fixture 100 having a light fixture housing 1002 that includes a light assembly housing 1004 and a driver assembly housing 1006, according to another example embodiment of the present disclosure. In the illustrated embodiment of FIG. 10, the driver assembly housing 1006 is obstructed from view by a cover 1007. The example cover 1007 may be integrated with the light fixture housing 1002 or may be connected to the light fixture housing 1002. In some examples, the cover 1007 may be omitted, as shown in FIG. 11.

The example driver assembly housing 1006 shown in FIG. 11 has a smaller width compared to the driver assembly housing 110 of FIG. 1. The smaller width of the driver assembly housing 1006 limits placement of the driver 206, ensuring, for example, that the driver 206 is accessible when the driver assembly housing 1006 is slid to an opening in a ceiling. It should be appreciated that the width of the driver assembly housing 1006 is approximately equal or slightly less than a width of the light fixture housing 1002 at section 1008. This ensures that when the light assembly housing 1004 is slid into the section 1008, the driver assembly housing 1006 is aligned with an opening in a ceiling and/or moved beyond the cover 1007 of the light fixture housing 1002.

The embodiment illustrated in FIG. 11 includes rails 1010 configured to enable the driver assembly housing 1006 to slide with respect to the light fixture housing 1002. The rails 1010 are integrated with or otherwise connected to the light fixture housing 1002 in place of the slots 112 described in connection with FIG. 1. The driver assembly housing 1006 includes a rail 1012 configured to connect to the rail 1010 of the light fixture housing 1002. The rail 1012 slides between the rails 1010, thereby enabling the driver assembly housing 1006 to move or slide with respect to the light fixture housing 1002. In other examples, the driver assembly housing 1006 may include a rod, similar to the rod 104 of FIG. 1 that connects or contacts the rails 1010. The light assembly housing 1004 may also moveably connected to the light fixture housing 1002 using rails similar to those used for the driver assembly housing 1006.

The example light fixture housing 1002 of FIGS. 10 and 11 includes supports 1020 and 1022 for mounting bars 160. Supports 1022*a* and 1022*b* are configured to connect respective mounting bars 160*a* and 160*b* to the light fixture housing 1002 at opposing ends. In addition, supports 1020*a* and 1020*b* are configured to connect respective mounting bars 160*a* and 160*b* to the light fixture housing 1002 at opposing sides. The presence of supports 1020*a* and 1020*b* at opposite sides of the light fixture housing 1002 provides installation flexibility based on a layout of cross beams or supports in a structure. For example, an electrician may change the bars 160 from the supports 1022 to the supports 1020 to better position or secure the light fixture housing 1002 in a ceiling based on location and spacing of cross-beams. The telescoping configuration of the mounting bars 160 enable their use in either of supports 1020 and 1022 despite the difference in end and side length of the light fixture housing 1002.

It should be appreciated that the mounting bars 160 of FIGS. 10 and 11 may be connected to brackets 1024, which provide a mechanical connection to a support or beam using a nail or other fastener. In some instances, the brackets 1024 may be replaced with the brackets 162 of FIG. 1. Additionally or alternatively, the brackets 1024 and 162 may be interchangeable. In FIGS. 10 and 11, the brackets 1024 are shown as including a lip 1026, which is configured to catch or otherwise contact an edge of a support or beam. The lip 1026 may help square the bracket 1024 with the support or beam. In addition, the alignment of the lip 1026 with a bottom of a support or beam helps ensure the light fixture housing 1002 is installed at a proper height with respect to a ceiling. Installing the light fixture housing 1002 too high into a ceiling may prevent a recessed light assembly from being properly installed.

Figure 12:
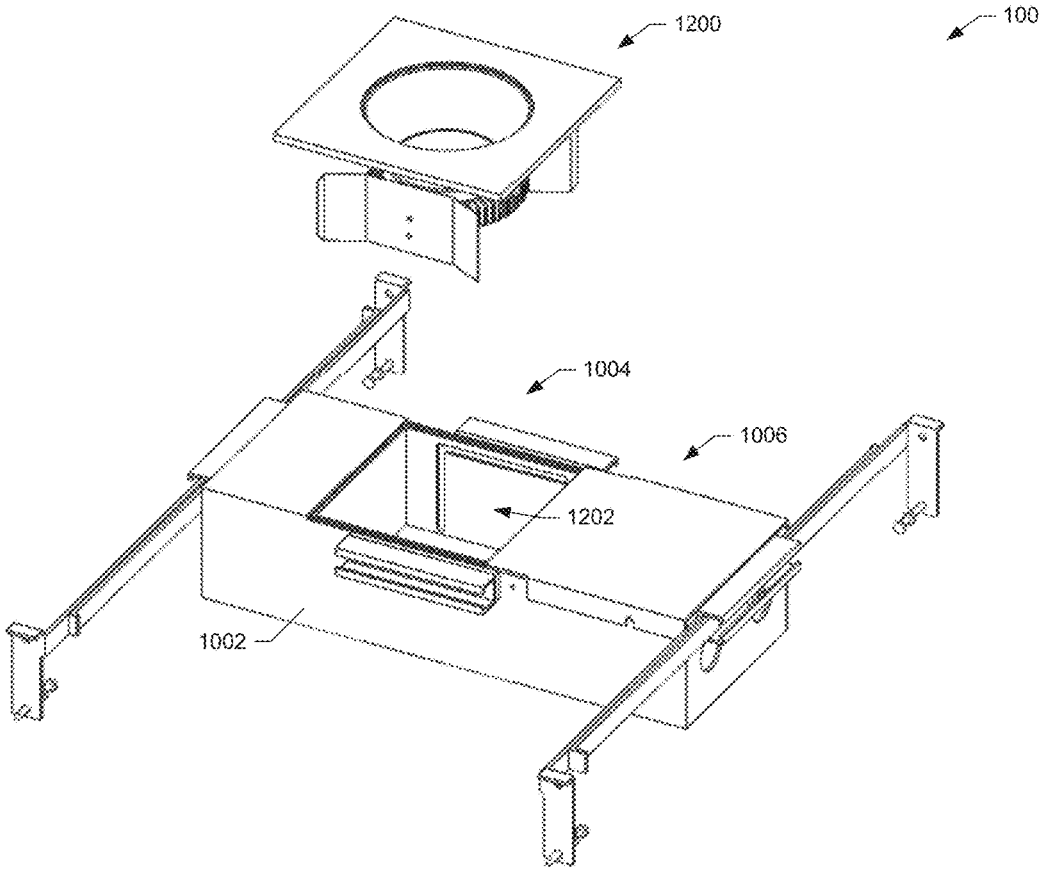
FIG. 12 shows a diagram of the recessed lighting fixture of FIGS. 10 and 11 with a recessed light assembly removed from the light assembly housing, according to an example embodiment of the present disclosure.

FIG. 12 shows a diagram of the recessed lighting fixture 100 of FIGS. 10 and 11 with a recessed light assembly 1200 removed from the light assembly housing 1004, according to an example embodiment of the present disclosure. The recessed light assembly 1200 may be removed to enable access to service, for example, the driver 206 of FIGS. 10 and 11. After removal, the light assembly housing 1004 and the driver assembly housing 1006 are slid to the left (from the perspective of the viewer), thereby aligning the driver assembly housing 1006 with opening 1202. The driver assembly housing 1006 may then be slid or pulled out from the light fixture housing 1002 through the opening 1202 to enable service and/or replacement of the driver 206.

Figure 13:
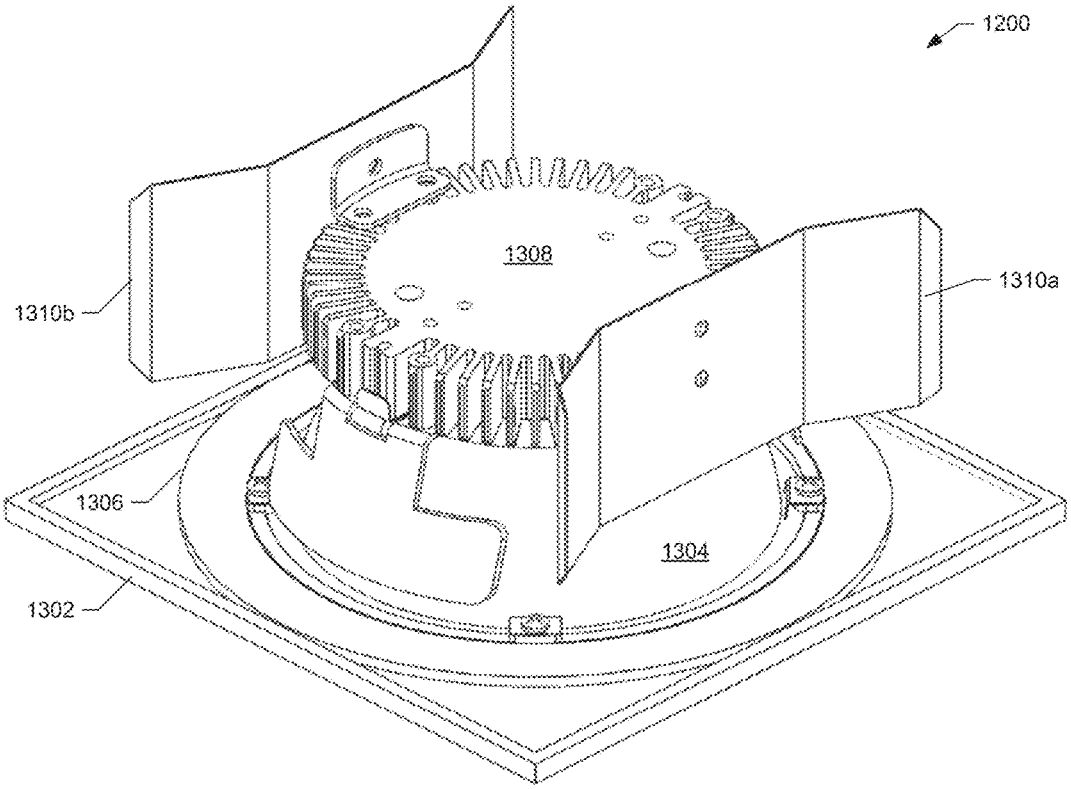
FIG. 13 shows a diagram of a perspective view of the recessed light assembly of FIG. 12, according to an example embodiment of the present disclosure

FIG. 13 shows a diagram of a perspective view of the recessed light assembly 1200 of FIG. 12, according to an example embodiment of the present disclosure. The recessed light assembly 1200 is similar to the recessed light assembly 150 of FIGS. 1 and 2 and is configured to electrically and mechanically connect to a light receptacle within the light assembly housing 1004.

In the example of FIG. 13, the recessed light assembly 1200 includes a trim piece 1302 that is configured to cover an opening in a ceiling. The assembly 1200 also includes a cup 1304 configured to direct, reflect, and/or refract light in a predesignated manner. A support ring 1306 is connected to a base of the cup 1304 and configured to engage or otherwise connect to the trim piece 1302.

The example recessed light assembly 1200 also includes a heat sink 1308 configured to disperse heat from a light bulb or other lighting element. Wires may be routed through holes in the heat sink to provide an electrical connection to wires or terminals within the light receptacle within the light assembly housing 1004. Wing connectors 1310 are connected to sides of the heat sink 1308 to mechanically connect the recessed light assembly 1200 to the light receptacle within the light assembly housing 1004. While two wing connectors 1310 are shown, it should be appreciated that additional or fewer connectors may be used. The wing connectors 1310 are configured to mechanically engage corresponding matching structure within the light receptacle. In some embodiments, the wing connectors 1310 may be press-fittingly connected to the light receptacle. In other examples, the wing connectors 1310 may lock into the light receptacle. In yet other examples, the wing connectors 1310 may be mechanically connected via screws or other fasteners to the light receptacle.

CONCLUSION

It should be understood that various changes and modifications to the example embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A recessed lighting fixture apparatus comprising:

a light fixture housing including at least one rail, a first opening configured to face an internal side of a ceiling, and a closed side opposite of the first opening;

a light assembly housing located within the light fixture housing such that a closed side of the light assembly housing is adjacent to the closed side of the light fixture housing, the light assembly housing configured to slide horizontally within the light fixture housing along the at least one rail, the light assembly housing including a second opening, opposite the closed side, configured to face the internal side of the ceiling, a light receptacle including a lighting element, and a recessed light assembly including a lens, the recessed light assembly configured to mechanically connect to the light receptacle; and a driver electrically connected to the light receptacle and located adjacent to the light assembly housing, wherein, in a first position, the light assembly housing is positioned within the light fixture housing such that the second opening is aligned with the first opening to enable the lighting element to emit light out of the light fixture housing, wherein, in a second position, the light assembly housing is slid horizontally within the light fixture housing to enable access through the first opening of the light fixture housing to the driver, and wherein at least one of the light receptacle and the recessed light assembly includes a heat sink configured to be contained within the light assembly housing such that the heat sink is located in the first position when the recessed light assembly is located in the first position and located in the second position when the recessed light assembly is located in the second position.

2. The recessed lighting fixture apparatus of claim 1, wherein, in the second position, at least a portion of the second opening of the light assembly housing is hidden from view of the first opening.

3. The recessed lighting fixture apparatus of claim 1, wherein the driver is located within a driver assembly housing including a third opening configured to face the internal side of the ceiling, the driver assembly housing being mechanically connected to the light assembly housing.

4. The recessed lighting fixture apparatus of claim 3, wherein the mechanical connection of the driver assembly housing to the light assembly housing enables the driver assembly housing and the light assembly housing to slide together horizontally within the light fixture housing.

5. The recessed lighting fixture apparatus of claim 1, wherein the light assembly housing further includes a lock configured, when engaged, to prevent the light assembly housing from being slid within the light fixture housing.

6. The recessed lighting fixture apparatus of claim 1, further comprising:

two parallel mounting bars connected to respective external sides of the light fixture housing; and brackets located at ends of each of the two mounting bars, the brackets configured to connect to a support structure in the ceiling.

7. The recessed lighting fixture apparatus of claim 6, wherein each of the two parallel mounting bars is configured to be telescoping for length adjustment.

8. The recessed lighting fixture apparatus of claim 1, wherein the driver includes at least one of an electrical driver, a ballast, and a transformer.

9. The recessed lighting fixture apparatus of claim 1, further comprising a trim piece configured to be connected to the light fixture housing at the first opening.

10. The recessed lighting fixture apparatus of claim 1, wherein the light assembly housing includes a box with an open side configured to define the second opening.

11. A recessed lighting fixture apparatus comprising:

a light fixture housing including a first opening configured to face an opening in a ceiling;

a light assembly housing configured to slide horizontally within the light fixture housing, the light assembly housing including a second opening configured to face the opening in the ceiling, and a light assembly including a lighting element and a heat sink; and a driver electrically connected to the light element, wherein, in a first position, the light assembly housing is positioned within the light fixture housing such that the second opening is aligned with the first opening to enable the lighting element to emit light out of the light fixture housing, wherein, in a second position, the light assembly housing is slid horizontally within the light fixture housing to enable access through the first opening of the light fixture housing to the driver, and wherein the heat sink is configured to be contained within the light assembly housing such that the heat sink is located in the first position when the recessed light assembly is located in the first position and located in the second position when the recessed light assembly is located in the second position.

12. The recessed lighting fixture apparatus of claim 1, wherein the diver is located adjacent to the light assembly housing.

13. The recessed lighting fixture apparatus of claim 11, wherein, in the second position, at least a portion of the second opening of the light assembly housing is behind a non-opening portion of the ceiling.

14. The recessed lighting fixture apparatus of claim 11, wherein the light assembly housing includes a heat sink.

15. The recessed lighting fixture apparatus of claim 11, wherein the heat sink is mechanically connected to the light assembly.

16. The recessed lighting fixture apparatus of claim 11, further comprising:

two parallel mounting bars connected to respective external sides of the light fixture housing; and brackets located at ends of each of the two mounting bars, the brackets configured to connect to a support structure in the ceiling.

17. The recessed lighting fixture apparatus of claim 11, further comprising a trim piece configured to be connected to the light fixture housing at the first opening.

18. The recessed lighting fixture apparatus of claim 11, further comprising at least one rail configured to enable the light assembly housing to slide horizontally within the light fixture housing.

19. The recessed lighting fixture apparatus of claim 11, wherein the first opening of the light fixture housing and the second opening of the light assembly housing have at least one of a rectangular shape and a square shape.

20. The recessed lighting fixture apparatus of claim 11, wherein the driver includes at least one of an electrical driver, a ballast, and a transformer.

* * * * *